US007520332B2

(12) United States Patent
Smithson

(10) Patent No.: US 7,520,332 B2
(45) Date of Patent: Apr. 21, 2009

(54) METHOD AND ASSOCIATED SYSTEM FOR SETTING DOWNHOLE CONTROL PRESSURE

(76) Inventor: Mitchell C. Smithson, 6603 Avenel Dr., Pasadena, TX (US) 77505

( * ) Notice: Subject to any disclaimer, the term of this patent is extended or adjusted under 35 U.S.C. 154(b) by 279 days.

(21) Appl. No.: 11/481,711

(22) Filed: Jul. 6, 2006

(65) Prior Publication Data

US 2007/0012455 A1 Jan. 18, 2007

(51) Int. Cl.
*E21B 34/10* (2006.01)

(52) U.S. Cl. ..... 166/375; 166/336; 166/72; 137/14

(58) Field of Classification Search ..... 166/250.01, 166/250.07, 375, 64, 72, 336; 137/14, 624.11
See application file for complete search history.

(56) References Cited

U.S. PATENT DOCUMENTS 2,245,005 A * 6/1941 Nixon ..... 417/110
3,391,263 A * 7/1968 Young ..... 200/82 R
4,308,884 A * 1/1982 Hoerger et al. ..... 137/14
4,687,014 A * 8/1987 Godal ..... 137/14
5,251,703 A 10/1993 Skinner
5,273,112 A 12/1993 Schultz
5,355,960 A 10/1994 Schultz et al.
5,547,029 A 8/1996 Rubbo et al.
6,179,052 B1 1/2001 Purkis et al.
6,543,544 B2 4/2003 Schultz et al.
6,585,051 B2 7/2003 Purkis et al.
6,736,213 B2 5/2004 Bussear et al.
2004/0244475 A1 * 12/2004 Butler et al. ..... 73/152.51

OTHER PUBLICATIONS

International Preliminary Report on Patentability and Written Opinion issued for International Patent Application No. PCT/US05/025109 dated Jan. 24, 2008 (6 pages).

* cited by examiner

*Primary Examiner*—Kenneth Thompson

(57) ABSTRACT

A method and associated system for setting downhole control pressure. A method of setting a downhole control pressure includes the steps of: installing a pressure control system with a pressure source; connecting a proximal end of a line to the pressure source and a distal end to a well tool; and calibrating the system by applying an overshoot pressure to the proximal end, then sensing a settled pressure in the proximal end resulting from the overshoot pressure, and determining a mathematical relationship between the overshoot and settled pressures. A system for setting a downhole control pressure includes a pressure source, a pressure limiter and an interface for applying pressure to a proximal end of a control line and a well tool connected to a distal end of the control line. The well tool is operated in response to a predetermined settled pressure achieved at the distal end in response to an overshoot pressure being applied to the proximal end and the pressure limiter limiting application of pressure from the pressure source to the proximal end to the overshoot pressure.

20 Claims, 2 Drawing Sheets

METHOD AND ASSOCIATED SYSTEM FOR SETTING DOWNHOLE CONTROL PRESSURE

BACKGROUND

The present invention relates generally to procedures and equipment utilized in conjunction with subterranean well operations and, in an embodiment described herein, more particularly provides a method and associated system for setting downhole control pressure.

Various hydraulically controlled downhole tools are presently used in subterranean wells. A majority of these tools are flow control devices, such as valves and chokes, although other types of tools are also available which are hydraulically controlled. Pressure may be applied to the tools via one or more control lines which extend between the tool and a pressure source, such as a pump at the earth's surface.

Some of these well tools perform different functions or operate in different manners based on certain pressure levels applied to the tools, sequences of pressures at certain levels applied to the tools, or combinations of certain pressure levels in multiple lines connected to the tools, etc. In order to reliably operate the tools, an operator should accurately know what pressure is applied to the tool downhole. Note that an "application" of pressure can be an increase in pressure or a decrease in pressure as desired or as required by a particular control system.

Examples of hydraulically controlled well tools and methods of controlling operation of such tools are described in U.S. Pat. Nos. 6,470,970, 6,567,013 and 6,575,237. The disclosures of these prior patents are incorporated herein by this reference.

Unfortunately, in the typical case the control line is very long and has a relatively small flow area, and so there is significant resistance to transmission of pressure through the line. This means that pressure in the line measured at the surface is not necessarily the same as pressure in the line at the downhole well tool (even when corrected for hydrostatic pressure due to the fluid in the line). Instead, there is a significant time lag between application of a pressure to the line at the surface and a corresponding change in pressure in the line at the well tool.

Eventually, the pressure at the well tool will reach the pressure applied to the line at the surface (plus hydrostatic pressure in the line). However, it will take a very long time since the pressure at the well tool approaches the pressure applied to the line at the surface asymptotically.

Yet another complicating factor is that each well installation is different. The control line may be a different size or length, the fluid used in the line may be different, a temperature profile of the well may vary (which affects compressibility of the fluid in the line), air or other gases can be entrained in the fluid in the line, etc.

One solution to these problems is to install a pressure sensor at the well tool to directly measure the pressures applied to the tool. This does not solve the problem of the time lag between changing pressure at the surface and experiencing the changing pressure at the well tool, but at least the changed pressure can be measured at the well tool to determine whether a desired control pressure has been achieved.

Unfortunately, the use of a pressure sensor at the well tool brings with it another set of problems. For example, there is the expense and time required to install the pressure sensor. Provisions must be made for communicating with the sensor, such as via wireless telemetry, electrical or fiber optic lines, etc. The sensor and the communication system are subject to damage during installation and will likely need to be serviced periodically.

Therefore, it may be seen that a need exists for improved methods of setting downhole control pressures.

SUMMARY

In carrying out the principles of the present invention, a system and associated methods are provided which solve at least one problem in the art. One example is described below in which a pressure control system is calibrated by determining a mathematical relationship between an overshoot pressure applied to one end a control line and a settled pressure in the control line. Another example is described below in which a well tool is operated by applying an overshoot pressure to a control line beyond a desired pressure for operating the well tool.

In one aspect of the invention, a method of setting a downhole control pressure is provided. The method includes the steps of: installing a pressure control system at a well, the pressure control system including a pressure source; connecting a proximal end of a line to the pressure source and a distal end of the line to a well tool; and calibrating the system by applying an overshoot pressure to the proximal end of the line from the pressure source, then sensing a settled pressure in the proximal end of the line resulting from the first overshoot pressure, and determining a mathematical relationship between the overshoot pressure and the settled pressure.

In another aspect of the invention, a method of controlling operation of a downhole well tool includes the steps of: applying an overshoot pressure from a pressure source to a proximal end of a control line, the overshoot pressure being beyond a desired predetermined settled pressure which is required for operation of the well tool at a distal end of the control line; and then isolating the pressure source from the proximal end of the control line, thereby permitting pressure in the distal end of the line to achieve the desired settled pressure in response.

In yet another aspect of the invention, a system for setting a downhole control pressure is provided. The system includes a pressure source, a pressure limiter and an interface for applying pressure to a proximal end of a control line. A well tool is connected to a distal end of the control line. The well tool is operated in response to a predetermined settled pressure achieved at the distal end of the control line. The predetermined settled pressure is achieved in response to an overshoot pressure being applied to the proximal end of the control line from the pressure source and the pressure limiter limiting application of pressure from the pressure source to the proximal end of the control line to the overshoot pressure.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
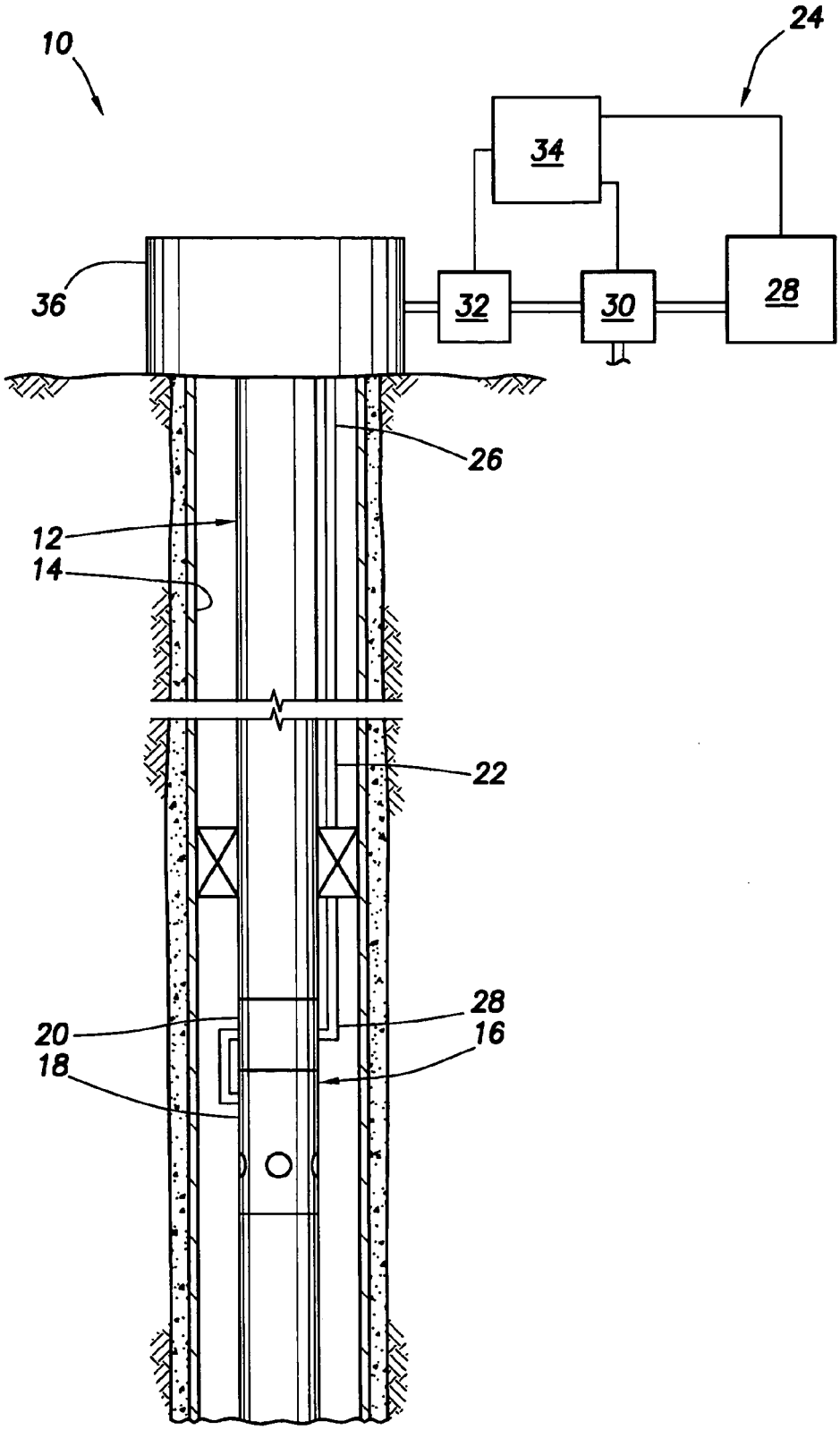
FIG. 1 is a schematic partially cross-sectional view of a method and associated system embodying principles of the present invention.

Representatively illustrated in FIG. 1 is a system 10 which embodies principles of the present invention. In the following description of the system 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

As depicted in FIG. 1, a tubular string 12 has been installed in a wellbore 14. A well tool 16 is interconnected in the tubular string 12. The well tool 16 includes a flow control device 18 (such as a valve, choke, etc.) and a control module 20.

The control module 20 controls operation of the flow control device 18 in response to pressure levels, sequences of pressures, combinations of pressures, etc. in one or more control lines 22. For clarity and simplicity in describing the system 10 below, it will be assumed that only a single control line 22 is used, but any number of control lines may be used in keeping with the principles of the invention.

Furthermore, although the system 10 is described herein as being used to control operation of the well tool 16 which includes the flow control device 18, it should be clearly understood that this is merely an example of a wide variety of well tools which may be used. For example, the well tool 16 could include a packer, chemical injection device, well testing tool, steam injection control, or any other type of downhole tool or device.

As another example, the control module 20 could be used to select from among multiple devices 18 which device(s) is to be operated and/or in what manner the selected device(s) should be operated. Thus, the control module 20 can perform a device selection function as well as a device operating function in the system 10. However, for simplification in the following description, it will be assumed that only the single device 18 is controlled using the control module 20, and so in this case no device selection function is performed by the control module.

In the example depicted in FIG. 1, the flow control device 18 is used to regulate flow into the tubular string 12. The flow is increased or decreased in response to pressure being applied to the control module 20 via the control line 22.

Preferably, the flow control device 18 is operated using a diaphragm or small pilot operated valves (not shown), so that the volume connected to the distal end 28 of the line 22 does not change significantly as the device is operated. However, the system 10 can be designed to accommodate significant volume changes if desired (such as to displace a sleeve of a sliding sleeve valve using the fluid in the line 22, etc.).

Pressure is applied to the control line 22 by a pressure control system 24 positioned at a location remote from the well tool 16. For example, the pressure control system 24 could be positioned at the earth's surface (including on a well platform, a floating rig, at a subsea wellhead or mudline, etc.) and the well tool 16 could be installed thousands of feet downhole.

As discussed above, pressure applied by the pressure control system 24 to a proximal end 26 of the control line 22 does not usually result in the same pressure being immediately applied to a distal end 28 of the control line. However, proper operation of certain well tools 16 requires that certain pressure levels be applied to the control module 20.

The pressure control system 24 preferably includes a pressure source 28, a pressure limiter 30, a pressure sensor 32 and an operator interface 34. The pressure source 28 could be a source of reduced pressure (such as a dump chamber or vent, etc.) or a source of elevated pressure (such as a pump, accumulator or pressurized gas chamber, etc., or any combination of these).

The pressure limiter 30 is used to limit the pressure applied from the pressure source 28 to the proximal end 26 of the line 22. The pressure limiter 30 could be a valve which is closed to cease application of pressure from the pressure source 28. Alternatively, the pressure limiter 30 could be a pressure regulator which permits application of pressure from the pressure source 28 until a predetermined pressure has been applied to the proximal end 26 of the line 22.

If the pressure source 28 is a positive displacement pump, then the pressure limiter 30 could be a check valve of the pump which prevents flow from the proximal end 26 of the control line 22 to the pump. The pressure limiter 30 could include a pressure switch which closes a valve or ceases operation of a pump, etc. when a desired overshoot pressure has been applied to the proximal end 26 of the line 22. Thus, it should be clearly understood that any means of limiting pressure applied from the pressure source 28 to the proximal end 26 of the line 22 may be used in keeping with the principles of the invention.

The pressure sensor 32 is used to detect and monitor pressure in the proximal end 26 of the line 22. Note that the sensor 32, limiter 30 and pressure source 28, or any combination of these, could be integrated into a single element or package for convenience of installation.

The interface 34 is preferably a computerized control device which is connected to each of the pressure source 28, limiter 30 and sensor 32. Alternatively, one or more of these could be separately operated, for example, the pressure source 28 could be a pump which is turned on manually and allowed to pump continuously during the operation.

The interface 34 preferably includes at least three modes of operation. In a manual mode of operation, the interface 34 permits an operator to manually control various elements of the system 24, such as to open or close the limiter 30 or operate the pressure source 28, etc. In a calibration mode of operation, described more fully below, the interface 34 preferably executes a series of preprogrammed instructions in which the system 10 is characterized in a manner which permits a mathematical relationship between pressure applied to the proximal end 26 of the line 22 and pressure applied to the distal end 28 of the line to be determined. In a well tool control mode of operation, the interface 34 permits an operator to specify what pressure(s) are to be applied to the well tool 16 at the distal end 28 of the line 22, and the interface automatically operates the pressure source 28 and limiter 30, and monitors the sensor 32, using the information obtained in the calibration mode, so that an appropriate pressure is applied to the proximal end 26 of the line.

Of course, any operations which are described as being performed automatically could instead be performed manually, and vice versa. Furthermore, more or less or different combinations of operations could be performed using the interface 34 in keeping with the principles of the invention.

In FIG. 1 the pressure control system 24 is depicted as being connected to the proximal end 26 of the line 22 via a wellhead 36 at the earth's surface. Many other configurations are possible, for example, the pressure control system 24, or any portion thereof, could be located on an offshore platform or floating rig, at a subsea wellhead, or at any other location. The interface 34 could be located remote from any of the pressure source 28, limiter 30 or sensor 32.

Figure 2:
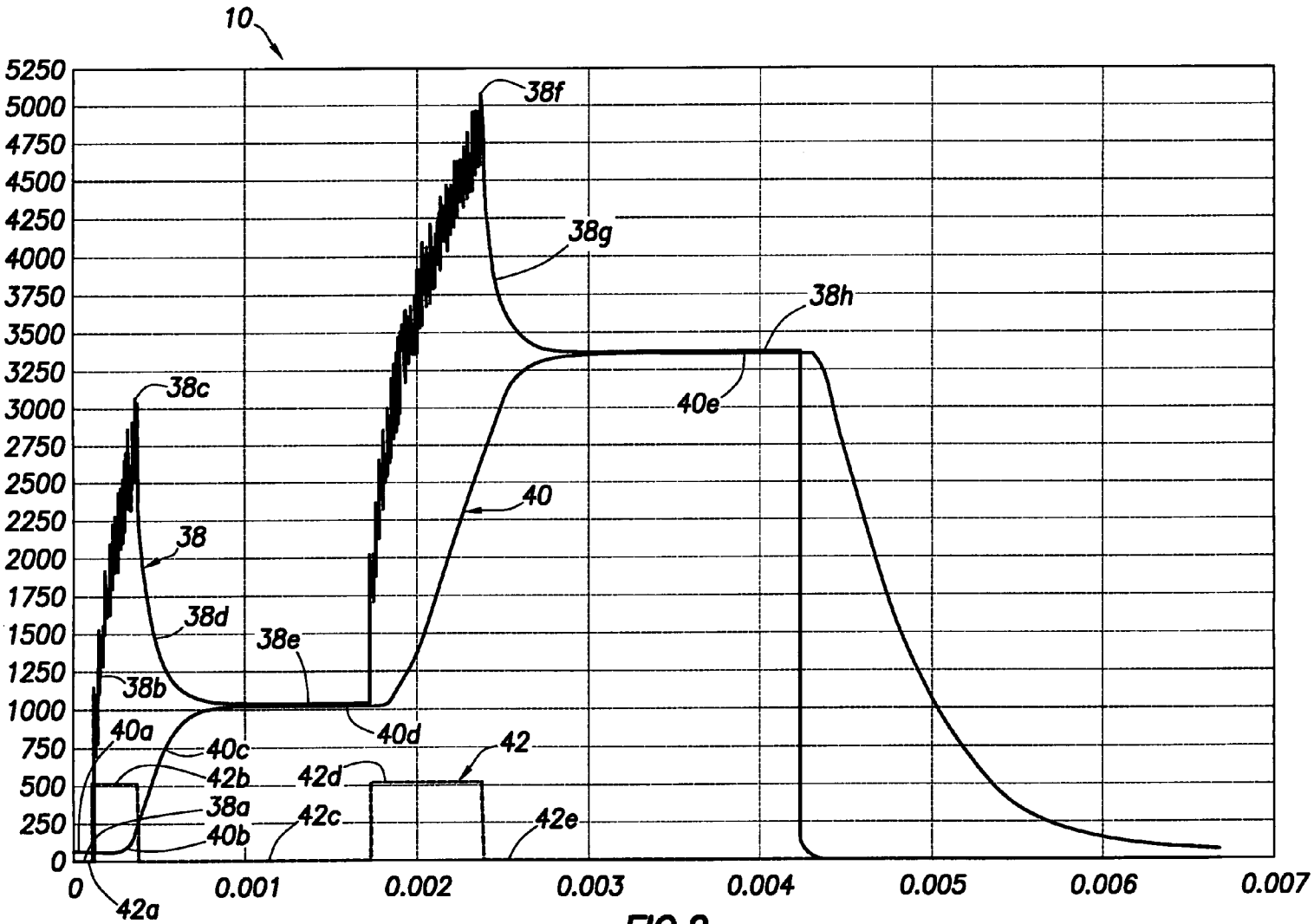
FIG. 2 is a representative graph of pressure at proximal and distal ends of a control line versus time in the method and system of FIG. 1.

Referring additionally now to FIG. 2, a graph of pressure 38 at the proximal end 26 of the line 22 and pressure 40 at the distal end 28 of the line versus time is representatively illustrated. The pressure 38 would be detected by the sensor 32 of the pressure control system 24.

Also shown in FIG. 2 is a dashed line 42 indicating operation of the pressure limiter 30. For the purpose of this description, it will be assumed that the pressure limiter 30 is a valve which is closed when the line 42 is at zero on the ordinate scale (preventing application of pressure from the pressure source 28 to the line 22), and the valve is open when the line 42 is above zero on the ordinate scale (permitting application of pressure from the pressure source to the line).

Initially, the limiter 30 is closed as indicated at 42*a*. Pressure on the proximal end 26 of the line 22 is zero (e.g., atmospheric pressure) as indicated at 38*a*. Pressure on the distal end 28 of the line 22 is somewhat greater than zero (e.g., due to hydrostatic pressure) as indicated at 40*a*.

To calibrate the system 10, the limiter 30 is opened to thereby apply pressure from the pressure source 28 to the proximal end 26 of the line 22 as indicated at 42*b*. Pressure increases relatively quickly in the proximal end 26 of the line 22 as indicated at 38*b*. Variations in the pressure at the proximal end 26 of the line 22 indicated at 38*b* are due to pressure pulses from the pressure source 28 in the case where the pressure source is a reciprocating or positive displacement pump. Other types of pressure sources may not produce such pressure variations.

Eventually, a certain calibration overshoot pressure is achieved at the proximal end 26 of the line 22 as indicated at 38*c*. As used herein, the term "overshoot pressure" is used to indicate a pressure applied at one portion of a line which is beyond (i.e., greater than in the case of increased pressure and less than in the case of reduced pressure) a desired pressure which results therefrom at a remote portion of the line.

In the pressure control system 24, the interface 34 preferably controls operation of at least the limiter 30 and monitors the sensor 32 so that when the sensor indicates that the calibration overshoot pressure 38*c* has been achieved, the limiter is automatically closed. Alternatively, or in addition, the pressure control system 24 could control operation of the pressure source 28 so that additional application of pressure to the line 22 is ceased (such as by turning off a pump, etc.) when the overshoot pressure 38*c* is achieved.

As the pressure at the proximal end 26 is transmitted through the line 22 after the overshoot pressure 38*c* is achieved, the pressure at the proximal end of the line gradually decreases as indicated at 38*d*. Note that the reduction in pressure at the proximal end 26 of the line 22 as indicated at 38*d* is in the form of a mathematical function known to those skilled in the art as an exponential decay.

It is instructive to note how the pressure at the distal end 28 of the line 22 responds to the application of pressure at the proximal end 26 of the line. After the limiter 30 is opened and pressure in the proximal end 26 of the line 22 begins to increase, pressure at the distal end 28 of the line also begins to increase. However, pressure at the distal end 28 of the line 22 increases at a much slower rate as indicated at 40*b*.

Pressure at the distal end 28 of the line 22 continues to increase (as indicated at 40*c*) after the limiter 30 is closed (as indicated at 42*c*). Note that pressure at the distal end 28 of the line 22 continues to increase as pressure at the proximal end 26 of the line 22 decreases (as indicated at 38*d*).

Eventually, the pressures at the proximal and distal ends 26, 28 of the line 22 will substantially equalize (corrected for hydrostatic pressure in the line 22) as indicated at 38*e* and 40*d*. This equalized pressure is termed the calibration "settled" pressure, since it is the steady state pressure in the line 22 which results after the overshoot pressure 38*c* is applied to the proximal end 26 of the line.

As part of the calibration mode of the interface 34, a mathematical relationship between the overshoot pressure 38*c* and the settled pressure 38*e* is determined. For example, if it is assumed that the pressure in the proximal end 26 of the line 22 will experience an exponential decay between the overshoot pressure 38*c* and the settled pressure 38*e*, then the pressure curve 38*d* could be described by a function such as:

$$P=(c-b)e^{(at)}+b \tag{1}$$

where P is the pressure in the proximal end 26 of the line 22, t is time, b is the settled pressure 38*e*, c is the overshoot pressure 38*c* and *a* is a constant dependent on the characteristics of the system 10.

Curve fitting techniques of the type known to those skilled in the art may be used to determine the values of the terms a, b and c so that the function closely approximates the pressure curve 38*d* between the overshoot pressure 38*c* and the settled pressure 38*e*. Using this information, in the well tool control mode of the interface 34, an operator can input the desired settled pressure (represented by the term b in equation 1) to the interface, and the required overshoot pressure (represented by the term c in equation 1) needed to achieve that settled pressure can be calculated by the interface. Then, the interface 34 preferably automatically operates the pressure source 28 and limiter 30, and monitors the sensor 32, so that the calculated overshoot pressure is applied to the proximal end 26 of the line 22.

Thus, once the system 10 is calibrated as described above, pressures can be accurately applied to the distal end 28 of the line 22 by applying corresponding calculated overshoot pressures to the proximal end 26 of the line.

The accuracy of the calibration mode of the interface 34 may be enhanced by applying multiple calibration overshoot pressures and observing multiple resulting calibration settled pressures. In FIG. 2, a second overshoot pressure as indicated at 38*f* is applied to the proximal end 26 of the line 22 by opening (as indicated at 42*d*) and then closing (as indicated at 42*e*) the limiter 30. The pressure at the proximal end 26 of the line 22 gradually declines (as indicated at 38*g*) until a settled pressure is reached (as indicated at 38*h*). In response to this application of the overshoot pressure 38*f*, the pressure at the distal end 28 of the line 22 gradually increases to the settled pressure (as indicated at 40*e*).

Alternatively, multiple observations may be used to characterize the system 10 based on the values of the overshoot 38*c*, 38*f* and settled pressures 38*c*, 38*h*. Linear interpolation may then be used to calculate what overshoot pressure should be applied to the proximal end 26 of the line 22 to produce a desired different settled pressure at the distal end 28 of the line.

Additional overshoot pressures (greater than two) could be used in the calibration mode of the interface 34 to provide an even more accurate characterization of the system 10. If additional overshoot pressures are used, then a piecewise linear approximation of the relationship between the overshoot and settled pressures could be produced for use in the well tool control mode of the interface 34.

Although in the description of the calibration mode of the interface 34 above an exponential delay is used to characterize the system 10 and as a basis for the mathematical relationship between the overshoot and settled pressures, it should be clearly understood that this is only one example of a wide variety of mathematical relationships which could be used. Furthermore, methods other than curve fitting could be used to determine the relationship between the overshoot and settled pressures. For example, neural networks, genetic algorithms, fuzzy logic, other types of artificial intelligence systems, regression analysis, etc. could be used instead, or in addition.

It may now be readily appreciated that the system 10 provides a convenient, efficient and accurate way to apply desired pressures to the well tool 16 to thereby control operation of the well tool. This result is accomplished without the need for installing a sensor to directly detect pressure at the distal end 28 of the line 22 (although such a sensor could be used if desired). In addition, the system 10 allows the desired settled pressure to be achieved quickly in response to application of the overshoot pressure.

It will also be appreciated that in the case where a desired pressure is to be applied to a well tool by decreasing a pressure on the well tool (i.e., reducing pressure on the well tool from a higher pressure to a lower desired pressure setpoint), the pressure source 28 could be a source of reduced pressure (such as a dump chamber, vent, etc.) and a pump may not be required to apply pressure to the line 22. In this situation, the interface 34 would be used to determine what overshoot pressure less than the desired settled pressure should be applied to the proximal end 26 of the line 22 to produce the desired pressure at the well tool.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A method of setting a downhole control pressure, the method comprising the steps of:

installing a pressure control system at a well, the pressure control system including a pressure source;

connecting a proximal end of a line to the pressure control system and a distal end of the line to a well tool; and calibrating the system by applying a first overshoot pressure to the proximal end of the line from the pressure source, then sensing a first settled pressure in the proximal end of the line resulting from the first overshoot pressure, and determining a first mathematical relationship between the first overshoot pressure and the first settled pressure.

2. The method of claim 1, wherein the calibrating step further comprises applying a second overshoot pressure to the proximal end of the line from the pressure source, then sensing a second settled pressure in the proximal end of the line resulting from the second overshoot pressure, and determining a second mathematical relationship between the second overshoot pressure and the second settled pressure.

3. The method of claim 2, wherein the calibrating step further comprises linearly interpolating based on the first and second mathematical relationships.

4. The method of claim 1, wherein the determining step further comprises representing the first mathematical relationship as an exponential decay function and determining values for terms of the function.

5. The method of claim 1, wherein the determining step further comprises determining the first mathematical relationship using an artificial intelligence system.

6. The method of claim 1, further comprising the step of calculating a second overshoot pressure using at least the first mathematical relationship which second overshoot pressure will result in a desired predetermined second settled pressure being achieved at the distal end of the control line.

7. The method of claim 6, further comprising the step of applying the second overshoot pressure to the proximal end of the control line.

8. A method of controlling operation of a downhole well tool, the method comprising the steps of:

applying an overshoot pressure from a pressure source to a proximal end of a control line, the overshoot pressure being beyond a desired predetermined settled pressure which is required for operation of the well tool at a distal end of the control line; and then isolating the pressure source from the proximal end of the control line, thereby permitting pressure in the distal end of the line to achieve the desired settled pressure in response.

9. The method of claim 8, wherein the isolating step further comprises permitting pressure in the proximal end of the control line to achieve the desired settled pressure in response to isolating the pressure source from the proximal end of the control line.

10. The method of claim 8, wherein the applying step further comprises increasing pressure in the proximal end of the control line.

11. The method of claim 8, wherein the applying step further comprises decreasing pressure in the proximal end of the control line.

12. The method of claim 8, further comprising the step of determining a mathematical relationship between the overshoot pressure and the desired settled pressure prior to the applying step.

13. The method of claim 12, further comprising the step of calibrating a pressure control system by applying at least one calibration overshoot pressure to the proximal end of the control line and sensing a calibration settled pressure at the proximal end of the control line.

14. The method of claim 13, wherein the mathematical relationship determining step further comprises using the calibration overshoot pressure and the calibration settled pressure in curve fitting to an exponential decay function.

15. The method of claim 13, wherein the mathematical relationship determining step further comprises using the calibration overshoot pressure and the calibration settled pressure in an artificial intelligence system.

16. A system for setting a downhole control pressure, the system comprising:

a pressure source, a pressure limiter and an interface for applying pressure to a proximal end of a control line; and a well tool connected to a distal end of the control line, the well tool being operated in response to a predetermined settled pressure achieved at the distal end of the control line, the predetermined settled pressure being achieved in response to an overshoot pressure being applied to the proximal end of the control line from the pressure source and the pressure limiter ceasing application of pressure from the pressure source to the proximal end of the control line when the overshoot pressure is achieved.

17. The system of claim 16, wherein the interface controls operation of the pressure limiter so that the pressure limiter is automatically operated to limit application of pressure from the pressure source to the proximal end of the control line to the overshoot pressure.

18. The system of claim 16, wherein the pressure limiter isolates the pressure source from the proximal end of the control line when the overshoot pressure has been applied to the proximal end of the control line.

19. The system of claim 16, wherein the interface has a calibration mode in which a mathematical relationship between the overshoot pressure and the settled pressure is determined.

20. The system of claim 16, wherein the overshoot pressure is beyond the settled pressure, so that when the pressure limiter limits application of pressure from the pressure source to the proximal end of the control line, gradual transmission of pressure from the proximal end to the distal end of the control line results in the settled pressure being achieved at the distal end of the control line.

* * * * *

UNITED STATES PATENT AND TRADEMARK OFFICE

CERTIFICATE OF CORRECTION

PATENT NO. : 7,520,332 B2
APPLICATION NO. : 11/481711
DATED : April 21, 2009
INVENTOR(S) : Mitchell C. Smithson It is certified that error appears in the above-identified patent and that said Letters Patent is hereby corrected as shown below:

On the Title Page, under Prior Publication Data, add section title, Item --(30) Foreign Application Priority Data--.

On the Title Page, Item (30) under Foreign Application Priority Data section, add --July 15, 2005 (WO) ……. PCT/US05/25109--.

Signed and Sealed this

Sixteenth Day of June, 2009

John Doll

JOHN DOLL
*Acting Director of the United States Patent and Trademark Office*